US007387534B2

(12) United States Patent
Ho

(10) Patent No.: US 7,387,534 B2
(45) Date of Patent: Jun. 17, 2008

(54) ELECTRICAL CONNECTOR

(75) Inventor: Chien-Chih Ho, Keelung (TW)

(73) Assignee: Lotes Co., Ltd., Keelung (TW)

( * ) Notice: Subject to any disclaimer, the term of this patent is extended or adjusted under 35 U.S.C. 154(b) by 27 days.

(21) Appl. No.: 11/375,395

(22) Filed: Mar. 15, 2006

(65) Prior Publication Data

US 2007/0218760 A1 Sep. 20, 2007

(51) Int. Cl.
*H01R 13/648* (2006.01)

(52) U.S. Cl. ..... 439/607; 439/610; 439/906; 361/737

(58) Field of Classification Search ..... 439/607, 439/610, 906; 361/737
See application file for complete search history.

(56) References Cited

U.S. PATENT DOCUMENTS 4,689,723 A * 8/1987 Myers et al. ..... 361/818
5,278,445 A * 1/1994 Uemura et al. ..... 257/678
5,417,590 A * 5/1995 Dechelette et al. ..... 439/607
5,660,558 A * 8/1997 Osanai et al. ..... 439/353
6,270,379 B1 * 8/2001 Huang et al. ..... 439/660
6,358,089 B1 * 3/2002 Kuroda et al. ..... 439/607
6,619,986 B1 * 9/2003 Yeh ..... 439/607
6,663,425 B1 * 12/2003 Zhang et al. ..... 439/607
6,726,492 B1 * 4/2004 Yu ..... 439/108
6,913,488 B2 * 7/2005 Motojima et al. ..... 439/607

* cited by examiner

*Primary Examiner*—Tulsidas C. Patel
*Assistant Examiner*—Harshad C Patel
(74) *Attorney, Agent, or Firm*—Troxell Law Office, PLLC

(57) ABSTRACT

An electrical connector is disclosed comprising: an insulating main body provided with a first fixture block and a second fixture block on two ends of its side; and a metal housing disposed on the exterior of the insulating main body and provided with a first through hole and a second through hole corresponding to the first fixture block and the second fixture block to interfere one another, such that a clasping structure with at least two opposite clasping directions is formed.

7 Claims, 7 Drawing Sheets

ELECTRICAL CONNECTOR

FIELD OF THE INVENTION

The present invention relates to an electrical connector and particularly to an electrical connector provided with a metal housing.

BACKGROUND OF THE INVENTION

For an electrical connector, especially the electrical connector in the field of high frequency communication, metal housing is usually used to secure the insulating main body inside an electrical connector. Consequently, the metal housing can shield the insulating main body and thus accommodate some electrical terminals inside the insulating main body so as to reduce the influence of the electromagnetic interference (EMI) on the signals transmitted in the electrical connector. The metal housing is usually made from pressing and bending of a metal sheet. A plurality of through holes are provided on its side, and a plurality of bumps are provided on the insulating main body corresponding to the through holes on the metal housing. The bumps are accommodated in the corresponding through holes such that the insulating main body can be secured in the metal housing. Because there are cracks present in the metal housing, the bumps tend to come off when the metal housing on the insulating main body is subjected to force such that the metal housing and the insulating main body cannot be secured together.

Consequently, it is necessary to design a new type of electrical connector to overcome the shortcoming described above.

SUMMARY OF THE INVENTION

An object of the present invention is to provide an electrical connector with a metal housing, wherein the metal housing and the insulating main body are firmly secured together.

In order to accomplish the aforementioned objects, an electrical connector according to the present invention comprises: an insulating main body provided with a first fixture block and a second fixture block on two ends of its side; and a metal housing disposed on the exterior of the insulating main body and provided with a first through hole and a second through hole corresponding to the first fixture block and the second fixture block, respectively, to interfere one another, such that a clasping structure with at least two opposite clasping directions is formed.

In order to accomplish the aforementioned objects, an electrical connector according to the present invention comprises: an insulating main body provided with at least a notch on its side; and a metal housing disposed on the exterior of the insulating main body and provided with at least a protrusion which can be complementarily matched to the notch such that the protrusion can be clasped with the notch to form a clasping structure when assembled.

In order to accomplish the aforementioned objects, an electrical connector according to the present invention comprises: an insulating main body protrudingly provided with at least a fixture block on its side; and a metal housing disposed on the exterior of the insulating main body and provided with at least a protrusion which can be complementarily matched to the fixture block such that the protrusion can be clasped with the fixture block to form a clasping structure when assembled.

Compared with conventional prior arts, an electrical connector according to the present invention is provided with a clasping structure with at least two opposite clasping directions between the insulating main body and the metal housing such that the metal housing can be clamped firmly with the insulating main body in two opposite directions such that thus the metal housing and the insulating main body can be firmly secured together.

BRIEF DESCRIPTION OF THE DRAWINGS

The present invention can be more fully understood by reference to the following description and accompanying drawings, in which.

DETAILED DESCRIPTION OF THE INVENTION

Referring to FIGS. 1 to 15, an electrical connector according to the present invention comprises an insulating main body 10, at least an electrical terminal 20, and a metal housing disposed on the exterior of the insulating main body 10, wherein the metal housing further comprises a first metal housing 30 and a second metal housing 40 clasped with the insulating main body 10, respectively. Furthermore, a clasping structure with at least two opposite clasping direction is provided between the insulating main body and the first metal housing 30 and the second metal housing 40.

Figure 1:
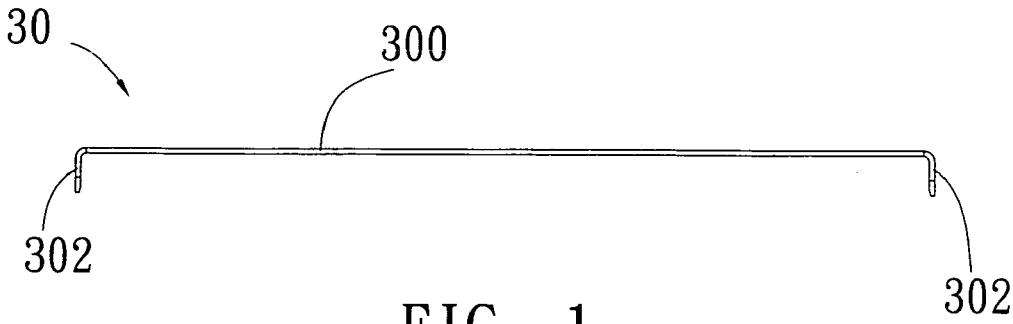
FIG. 1 is a front elevational view schematically illustrating a preferred embodiment of a first metal housing of an electrical connector according to the present invention.
Figure 2:
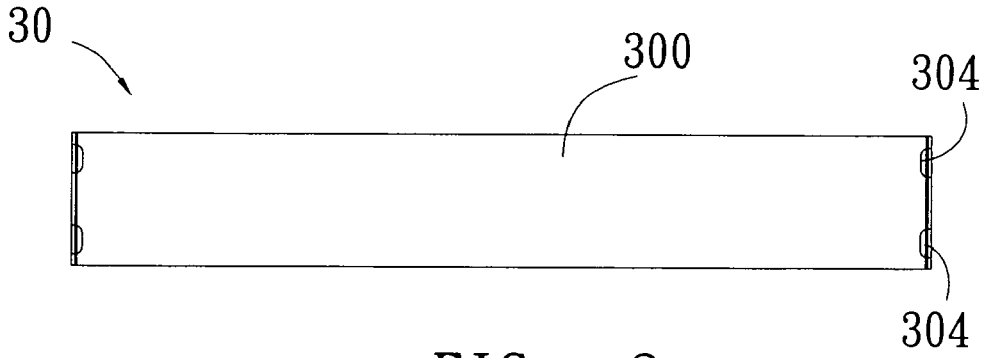
FIG. 2 is a plane view schematically illustrating the first metal housing shown in FIG. 1.
Figure 3:
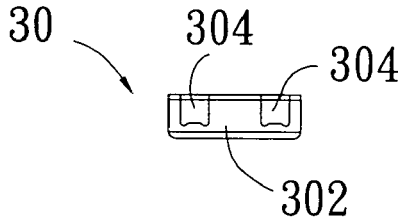
FIG. 3 is a right-sight view schematically illustrating the first metal housing shown in FIG. 1.
Figure 4:
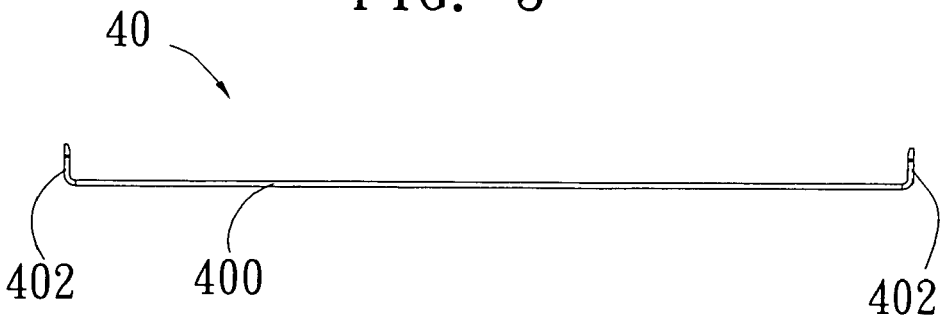
FIG. 4 is a front elevational view schematically illustrating a preferred embodiment of a second metal housing of an electrical connector according to the present invention.
Figure 5:
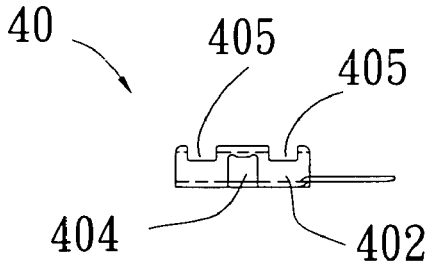
FIG. 5 is a plane view schematically illustrating the second metal housing shown in FIG. 4.
Figure 6:
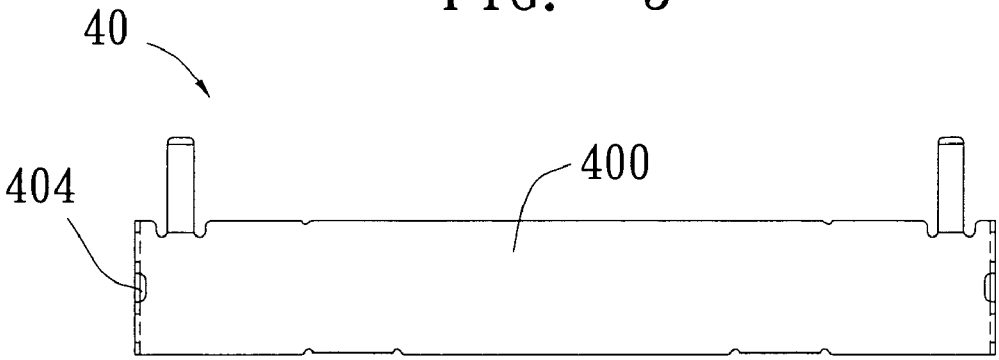
FIG. 6 is a right-sight view schematically illustrating the second metal housing shown in FIG. 4.
Figure 7:
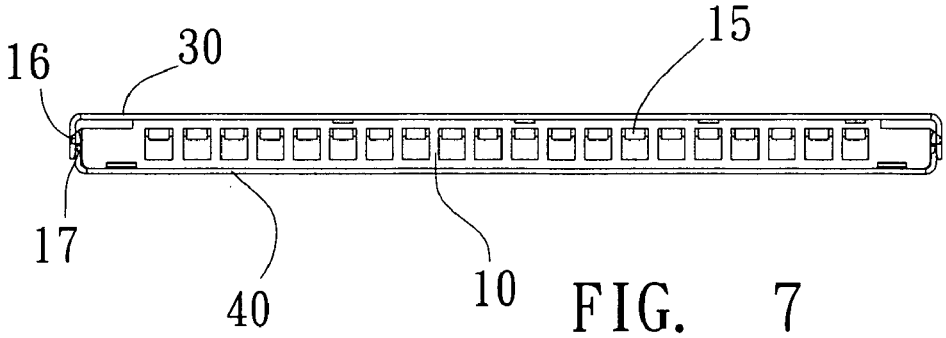
FIG. 7 is a front elevational view schematically illustrating a preferred embodiment of an electrical connector according to the present invention.
Figure 8:
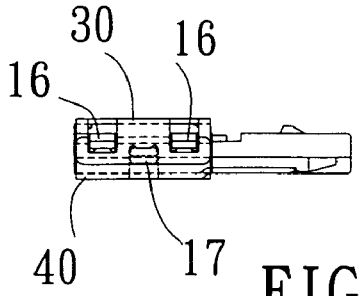
FIG. 8 is a right-sight view of the electrical connector shown in FIG. 7.
Figure 9:
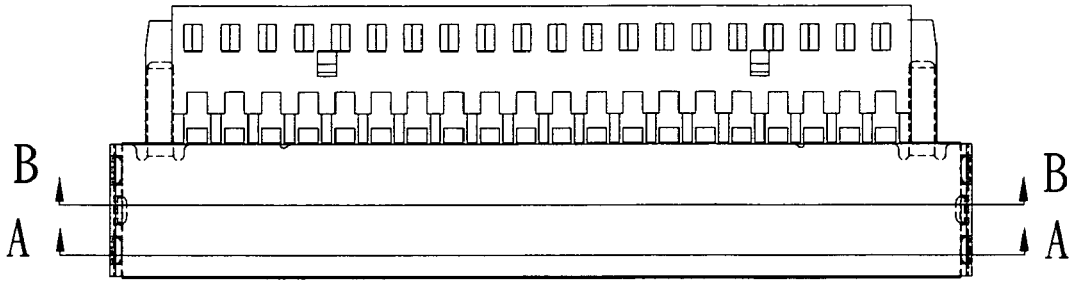
FIG. 9 is a plane view schematically illustrating the electrical connector shown in FIG. 7.
Figure 10:
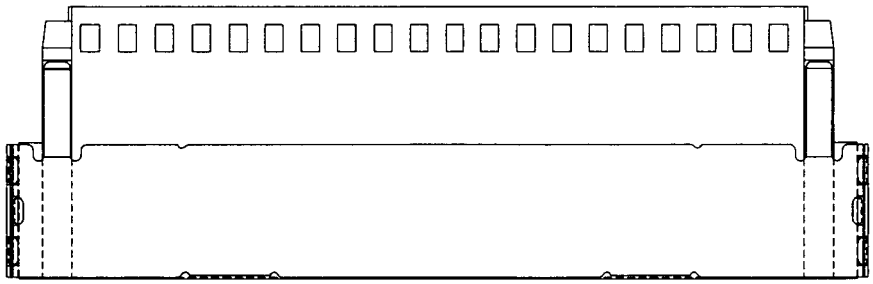
FIG. 10 is a bottom view schematically illustrating the electrical connector shown in FIG. 7.
Figure 11:
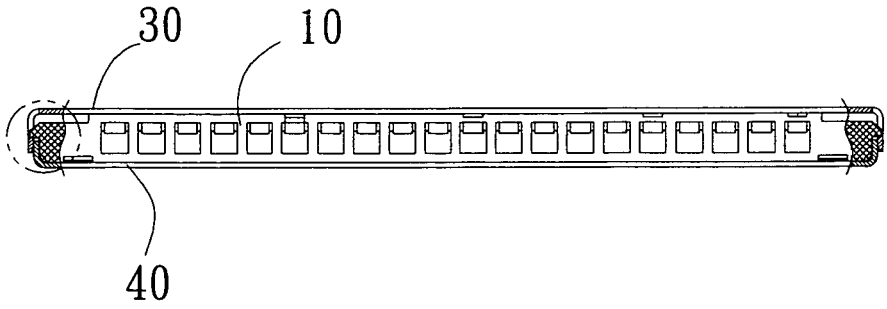
FIG. 11 schematically illustrates a cross-sectional view of the electrical connector taken through A-A line of FIG. 9.
Figure 12:
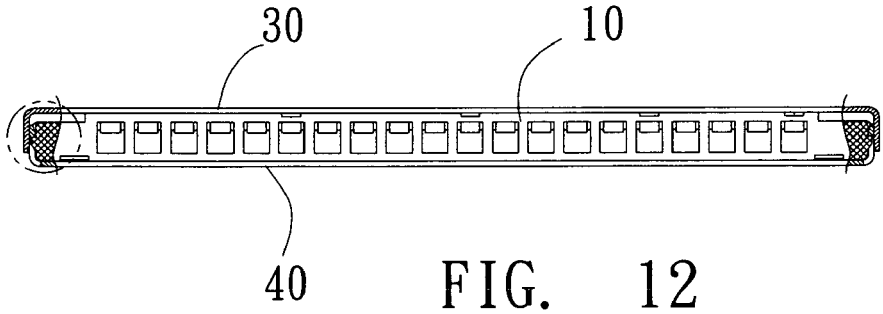
FIG. 12 schematically illustrates a cross-sectional view of the electrical connector taken through B-B line of FIG. 9.
Figure 13:
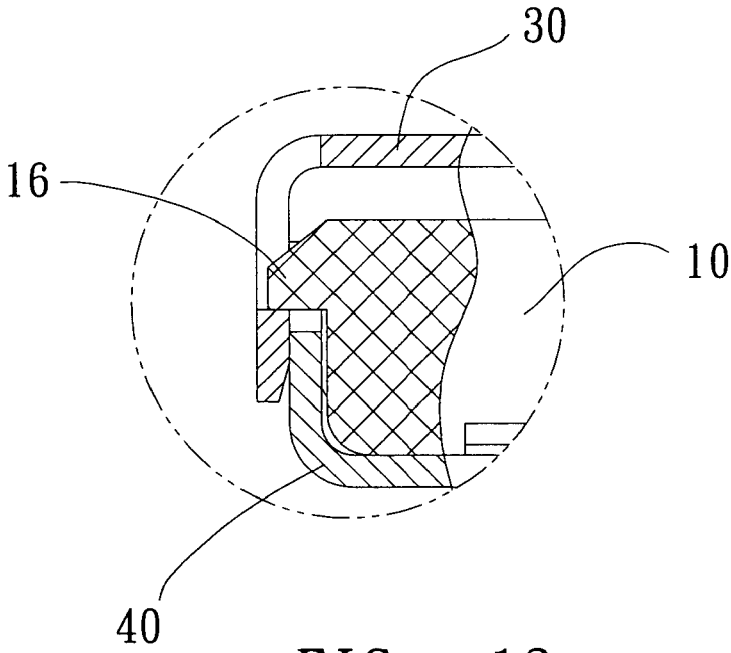
FIG. 13 schematically illustrates an enlarged local view of the electrical connector shown in FIG. 11.
Figure 14:
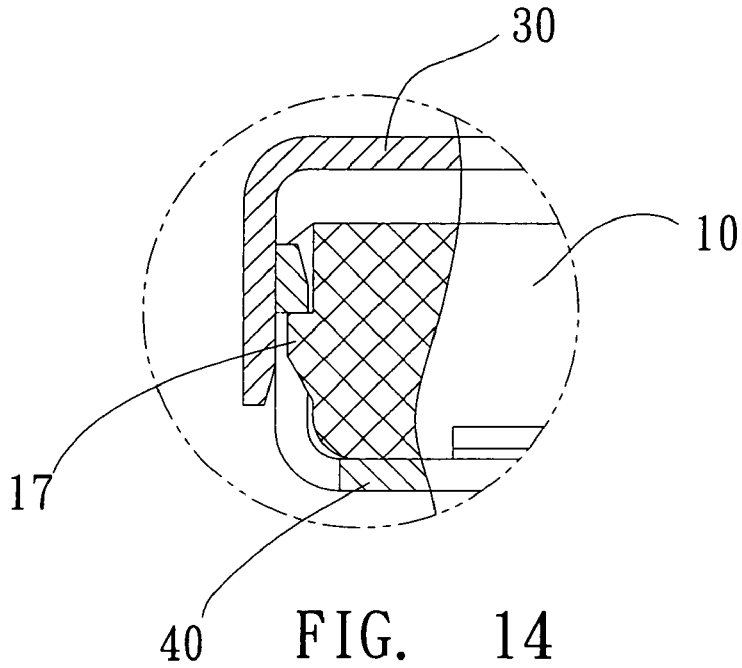
FIG. 14 schematically illustrates an enlarged local view of the electrical connector shown in FIG. 12.
Figure 15:
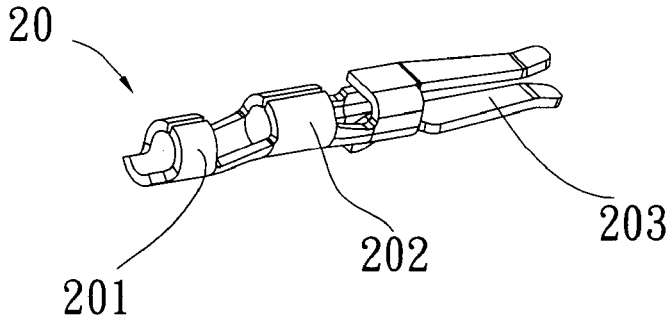
FIG. 15 is a perspective view schematically illustrating an electrical terminal of an electrical connector according to the present invention.

The insulating main body 10 comprises a upper and a lower surfaces as well as two sides (not shown). The insulating main body 10 is further provided with a plurality of terminal accommodating holes 15 therein. Each side of the insulating main body 10 is provided with three fixture blocks, wherein two first fixture blocks 16 disposed on both ends point to the same direction and one second fixture block 17 provided in the middle points to the opposite direction of the first fixture block 16. Preferably, the clasping direction of the first fixture blocks are the same and the clasping direction of the centrally located second fixture block are opposite the clasping direction of the first fixture blocks, as shown in FIG. 8.

The electrical terminal 20 comprises a first clipping portion 201 and a second clipping portion 202, wherein the first clipping portion 201 is used to clip the end (not shown) of a butt-jointed wire (not shown), and the second clipping portion 202 is to clip an contacting portion (not shown) of a protruding wire. The second clipping portion 202 is extending away from the direction of the first clipping portion 201 to form an elastic contacting portion 203. The elastic contacting portion 203 may be in contact with external electronic devices (such as an electrical terminal of another electrical connector (not shown)).

The first metal housing 30 and the second metal housing 40 both made from stamping and bending of metal sheets comprise a first base 300 and a second base 400 as well as a first butt-jointed portion 302 and a second butt-jointed portion 402 formed by extending inwardly and perpendicularly from one end of the first base body 300 and the second base body 400, respectively. When the metal housings 30 and 40 are disposed on the exterior of the insulating main body 10, the first butt-jointed portion 302 of the first metal housing 30 is disposed on the exterior of the second butt-jointed portion 402 of the second metal housing 40. A first through hole 304 and a second through hole 404 are provided with on the first butt-jointed portion 302 and the second butt-jointed portion 402 of the first metal housing 30 and the second metal housing 40, respectively, corresponding to the first fixture block 16 and the second fixture block 17 on both sides of the insulating main body 10. Also, the first through hole 304 and the second through hole 404 are disposed alternately, i.e. the first through hole 304 is disposed between the two first through holes 404. Furthermore, on the second butt-jointed portion 402, corresponding to the first through hole 304 provided on the first butt-jointed portion 302, is provided with a notch 405, which forms a space for the pass of the first fixture block 16.

Three fixture blocks are provided on the two sides of the insulating main body 10 of an electrical connector according to the present invention. The two first fixture blocks 16 on the both ends point to the same direction and the second fixture block 17 point to the opposite to the direction of the first fixture blocks 16. The first metal housing 30 and the second metal housing 40 are provided with the first through holes 304 and the second through holes 404 to integratedly match with the first fixture blocks 16 and the second fixture block 17. The two first fixture blocks 16 and the two first through holes 304 as well as the second fixture block 17 and the second through hole 404, respectively, form a clasping structure with three complementary concave and convex connecting portions, wherein the two on both ends point to the same direction and the one in the middle points to the opposite direction, such that the first metal housing 30 and the second metal housing 40 can be firmly secured with the insulating main body 10.

Figure 16:
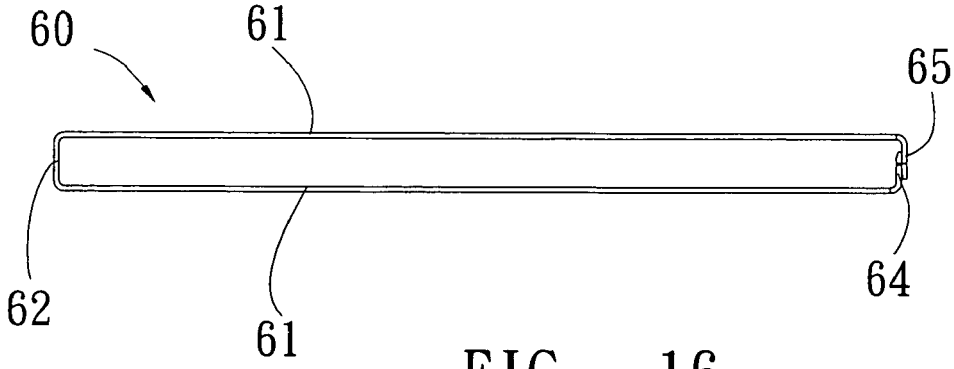
FIG. 16 is a plane view schematically illustrating another preferred embodiment of a metal housing of an electrical connector according to the present invention.
Figure 17:
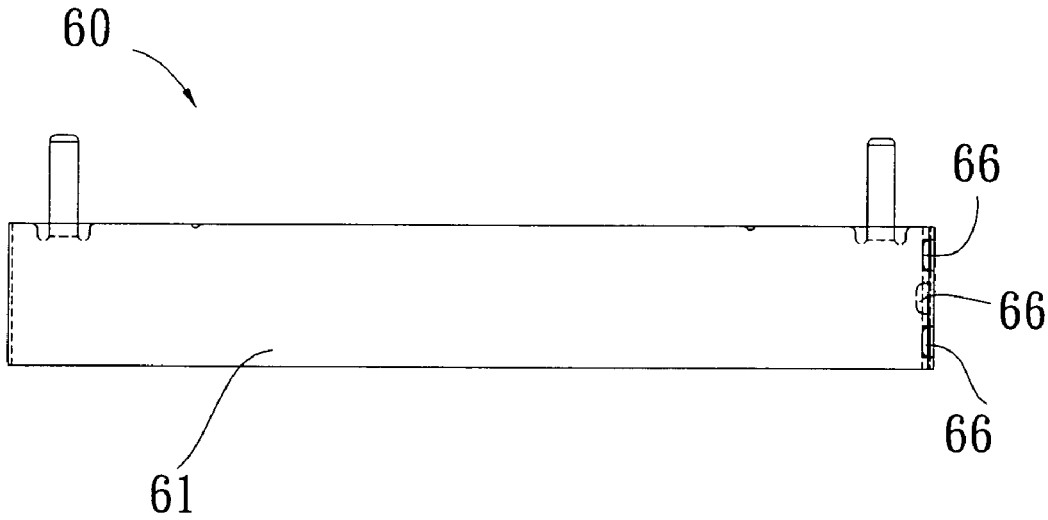
FIG. 17 is a plane view schematically illustrating the metal housing shown in FIG. 16.
Figure 18:
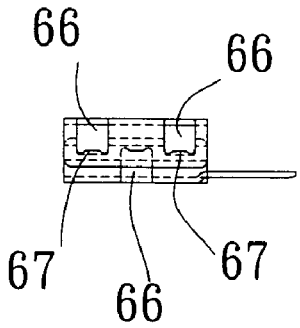
FIG. 18 is a right-sight view schematically illustrating the metal housing shown in FIG. 16.

Referring to FIGS. 16 to 18, an electrical connector according to another embodiment of the present invention is shown. Compared with the embodiment described above, the metal housing 60 in the present embodiment is an integratedly formed structure, comprising two flat base bodies 61, and a connection portion 62 connecting the two base bodies 61.

On the opposite side of the connection portion 62 in the metal housing 60 on, the ends of the two base bodies 61 is perpendicularly bended toward each other to form an inner butt-jointed portion 64 and an outer butt-jointed portion 65. A through hole 66 complementarily matched to a fixture block (not shown) provided on one side of the insulating main body 10 is provided on the inner butt-jointed portion 64 and the outer butt-jointed portion 65, respectively, wherein the through holes 66 are disposed alternately. Furthermore, a notch 67 provided at the inner butt-jointed portion 64 corresponding to the through hole 66 provided at the outer butt-jointed portion 65 can also achieve the goal described above.

Figure 19:
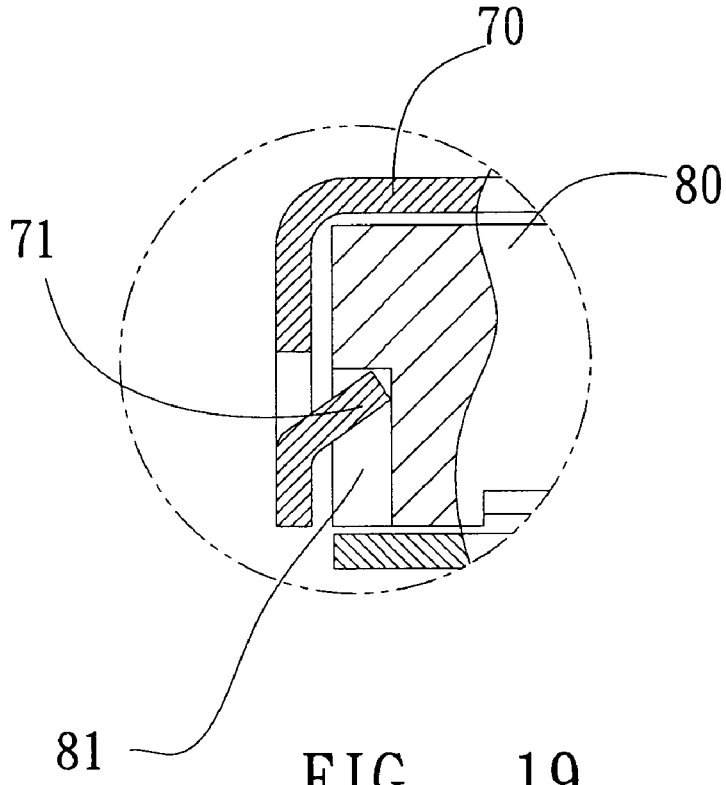
FIG. 19 schematically illustrates still another preferred embodiment of an electrical connector according to the present invention.
Figure 20:
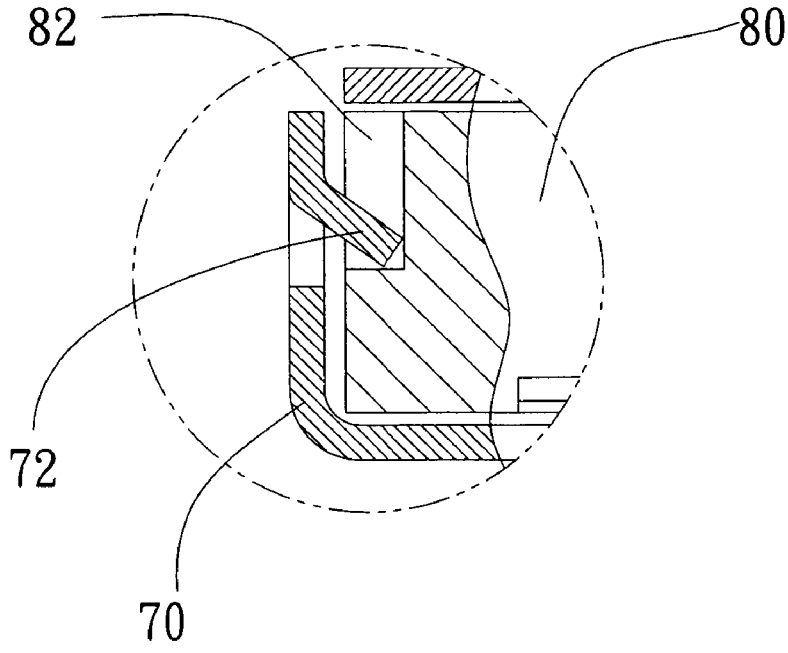
FIG. 20 schematically illustrates another enlarged local view of the electrical connector shown in FIG. 19.

Referring to FIGS. 19 and 20, still another embodiment of an electrical connector according to the present is shown. Compared with the embodiment described above, the clapping structure in the present embodiment is two protrusions 71 and 72, pointing to opposite directions, provided on a metal housing 70, and two notches 81 and 82 provided on a insulating main body 80, such that the protrusions 71 and 72 and the notches 81 and 82 can be complementarily matched, which can also achieve the goal described above.

Certainly, the clapping structure provided on an electrical connector according to the present invention can be protrusions and fixture blocks, pointing to opposite directions, provided on the metal housing 70 and the insulating main body 80, respectively, as well as notches and through holes provided on the insulating main body 80 and the metal housing 70, respectively. As long as a clasping structure is formed with at least two complementary protrusions and indentations of opposite clasping directions, the goal of the present invention can be achieved.

Consequently, an electrical connector according to the present invention provided with a metal housing, which can be firmly secured with the insulating main body, can overcome the drawback of the conventional prior arts.

While the invention has been described with reference to the a preferred embodiment thereof, it is to be understood that modifications or variations may be easily made without departing from the spirit of this invention, which is defined by the appended claims.

What is claimed is:

1. An electrical connector comprising:

an insulating main body provided with at least one first fixture block and a second fixture block on two ends of its side; and a metal housing disposed on the exterior of the insulating main body and provided with at least one first through hole and a second through hole corresponding to the first fixture block and the second fixture block to interfere one another, respectively, such that a clasping structure with at least two opposite clasping directions is formed, wherein the metal housing further comprises a first metal housing and a second metal housing clasped with the insulating main body, wherein the first metal housing and the second metal housing both made from stamping and bending of metal sheets comprise a first base and a second base as well as a first butt-jointed portion and a second butt-jointed portion formed by extending inwardly and perpendicularly from one end of the first base body and the second base body, respectively, such that when the two metal housings are disposed on the exterior of the insulating main body, the first butt-jointed portion of the first metal housing is disposed on the exterior of the second butt-jointed portion of the second metal housing, wherein the at least one first fixture block comprises two first fixture blocks pointing the same direction, wherein the second fixture block points to the opposite direction of the first fixture blocks.

2. An electrical connector comprising:

an insulating main body provided with a first fixture block and a second fixture block on two ends of its side; and a metal housing disposed on the exterior of the insulating main body and provided with a first through hole and a second through hole corresponding to the first fixture block and the second fixture block to interfere one another, respectively, such that a clasping structure with at least two opposite clasping directions is formed, wherein the metal housing is an integratedly formed structure, comprising two flat base bodies and an inner butt-jointed portion and an outer butt-jointed portion formed by perpendicularly bended from the two ends of the base bodies toward each other, wherein the metal housing is further provided with a plurality of through holes disposed alternately on the inner and outer butt-jointed portions, such that the through holes may be complementarily matched to the first fixture block and the second fixture block provided on one side of the insulating main body.

3. The electrical connector as defined in claim 2, wherein a notch is further provided at the inner butt-jointed portion corresponding to the through hole provided at the outer butt-jointed portion.

4. The electrical connector as defined in claim 2, wherein the first metal housing and the second metal housing both made from stamping and bending of metal sheets comprise a first base and a second base as well as a first butt jointed portion and a second butt jointed portion formed by extending inwardly and perpendicularly from one end of the first base body and the second base body, respectively, such that when the two metal housings are disposed on the exterior of the insulating main body, the first butt jointed portion of the first metal housing is disposed on the exterior of the second butt jointed portion of the second metal housing.

5. The electrical connector as defined in claim 2, wherein a notch is further provided at the inner butt jointed portion corresponding to the through hole provided at the outer butt jointed portion.

6. An electrical connector comprising:

an insulating main body provided with at least one first fixture block and a second fixture block on two ends of its side; and a metal housing disposed on the exterior of the insulating main body and provided with at least one first through hole and a second through hole corresponding to the first fixture block and the second fixture block to interfere one another, respectively, such that a clasping structure with at least two opposite clasping directions is formed, wherein the metal housing further comprises a first metal housing and a second metal housing clasped with the insulating main body, wherein the first metal housing and the second metal housing both made from stamping and bending of metal sheets comprise a first base and a second base as well as a first butt-jointed portion and a second butt-jointed portion formed by extending inwardly and perpendicularly from one end of the first base body and the second base body, respectively, such that when the two metal housings are disposed on the exterior of the insulating main body, the first butt-jointed portion of the first metal housing is disposed on the exterior of the second butt-jointed portion of the second metal housing, wherein the at least one first fixture block comprises two first fixture blocks, and the at least one first through hole comprises two first through holes, wherein the first through hole and the second through hole are provided with the first butt-jointed portion and the second butt-jointed portion of the first metal housing and the second metal housing, respectively, and the first through hole and the second through hole are disposed alternately, such that the two first fixture blocks and the two first through holes as well as the second fixture block and the second through hole, respectively, form a clasping structure with three complementary concave and convex connecting portions.

7. The electrical connector as defined in claim 6, wherein the second butt-jointed portion is provided with a notch thereon, which forms a space for the pass of the first fixture block.

* * * * *